US007847738B2

(12) United States Patent
Teng

(10) Patent No.: US 7,847,738 B2
(45) Date of Patent: Dec. 7, 2010

(54) MICROSTRIP ANTENNA

(75) Inventor: Jia-Lin Teng, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 338 days.

(21) Appl. No.: 12/206,730

(22) Filed: Sep. 8, 2008

(65) Prior Publication Data

US 2009/0243939 A1 Oct. 1, 2009

(30) Foreign Application Priority Data

Mar. 28, 2008 (CN) ..... 2008 1 0300767

(51) Int. Cl.
*H01Q 1/38* (2006.01)

(52) U.S. Cl. ..... 343/700 MS; 343/702; 343/767; 343/770; 343/846

(58) Field of Classification Search ..... 343/700 MS, 343/702, 767, 770, 846, 895
See application file for complete search history.

(56) References Cited

U.S. PATENT DOCUMENTS 7,183,982 B2 * 2/2007 Kadambi et al. ..... 343/702
7,319,432 B2 * 1/2008 Andersson ..... 343/702
7,342,500 B2 * 3/2008 Ho et al. ..... 340/572.7
7,432,861 B2 * 10/2008 Shih ..... 343/700 MS

FOREIGN PATENT DOCUMENTS

CN 1702908 11/2005

* cited by examiner

*Primary Examiner*—Douglas W Owens
*Assistant Examiner*—Chuc D Tran
(74) *Attorney, Agent, or Firm*—Frank R. Niranjan

(57) ABSTRACT

A microstrip antenna positioned on a substrate includes a feeding portion, a grounding portion, and a radiating portion. The substrate includes a first surface and a second surface opposite to the first surface. The feeding portion is positioned on the first surface. The grounding portion is positioned on the second surface. The radiating portion is positioned on the first surface, and includes a first radiator, a second radiator in zigzag shape, and a third radiator. The first radiator includes a first radiating section and a second radiating section. The third radiator includes a third radiating section and a fourth radiating section. The first radiating section, the second radiating section, the second radiator, the third radiating section, and the fourth radiating section are perpendicular to one another connected one by one in sequence. The first radiator and the third radiator co-define a receiving area, and the second radiator is positioned in the receiving area.

9 Claims, 4 Drawing Sheets

MICROSTRIP ANTENNA

BACKGROUND

1. Field of the Invention

Embodiments of the present disclosure relate to antennas, and particularly to a microstrip antenna.

2. Description of Related Art

Wireless metropolitan area network (WMAN) communication protocols comprise many standards for different markets and applications, such as IEEE 802.16, also called world interoperability for microwave access (WiMAX). The operating frequency of the mobile WiMAX in IEEE 802.16e includes 2.3 GHz and 2.7 GHz.

In order to make them more convenient, the wireless communication devices are built small. As antennas are necessary components in the wireless communication devices for radiating electromagnetic signals, one solution for reducing the dimensions of wireless communication devices is to reduce the dimensions of the antennas. Nowadays, some microstrip antennas are rectangular round, or ring shaped, and though small, there is still a demand that they be made smaller yet still provide the desired frequency coverage.

SUMMARY

An embodiment of the present disclosure provides a microstrip antenna. A microstrip antenna is positioned on a substrate and comprises a first surface and a second surface opposite to the first surface. The microstrip antenna comprises a feeding portion, a grounding portion, and a radiating portion. The feeding portion is positioned on the first surface, configured for feeding electromagnetic signals. The grounding portion is positioned on the second surface and electrically connected to the feeding portion. The radiating portion is positioned on the first surface, configured for transceiving the electromagnetic signals. The radiating portion comprises a first radiator, a second radiator, and a third radiator. The first radiator comprises a first radiating section electronically connected to the feeding portion and a second radiating section perpendicular to and electronically connected to the first radiating section. The second radiator comprises a zigzag shape, and has a first end and a second end, the first end is electronically connected to the second radiating section. The third radiator comprises a third radiating section and a fourth radiating section perpendicular to and electronically connected to the third radiating section. The third radiator has a third end and a fourth end. The third end is electronically connecting to the second end of the second radiator, and the fourth end of the third radiator extends from the third radiator and not connected any other radiating section, wherein the fourth radiating section is substantially perpendicular to the second radiating section of the first radiator. The first radiator and the third radiator co-define a receiving area, the second radiator is positioned in the receiving area.

Other objectives, advantages and novel features of the present disclosure will be drawn from the following detailed description of certain inventive embodiments of the present disclosure with the attached drawings, in which:

DETAILED DESCRIPTION

Figure 1:
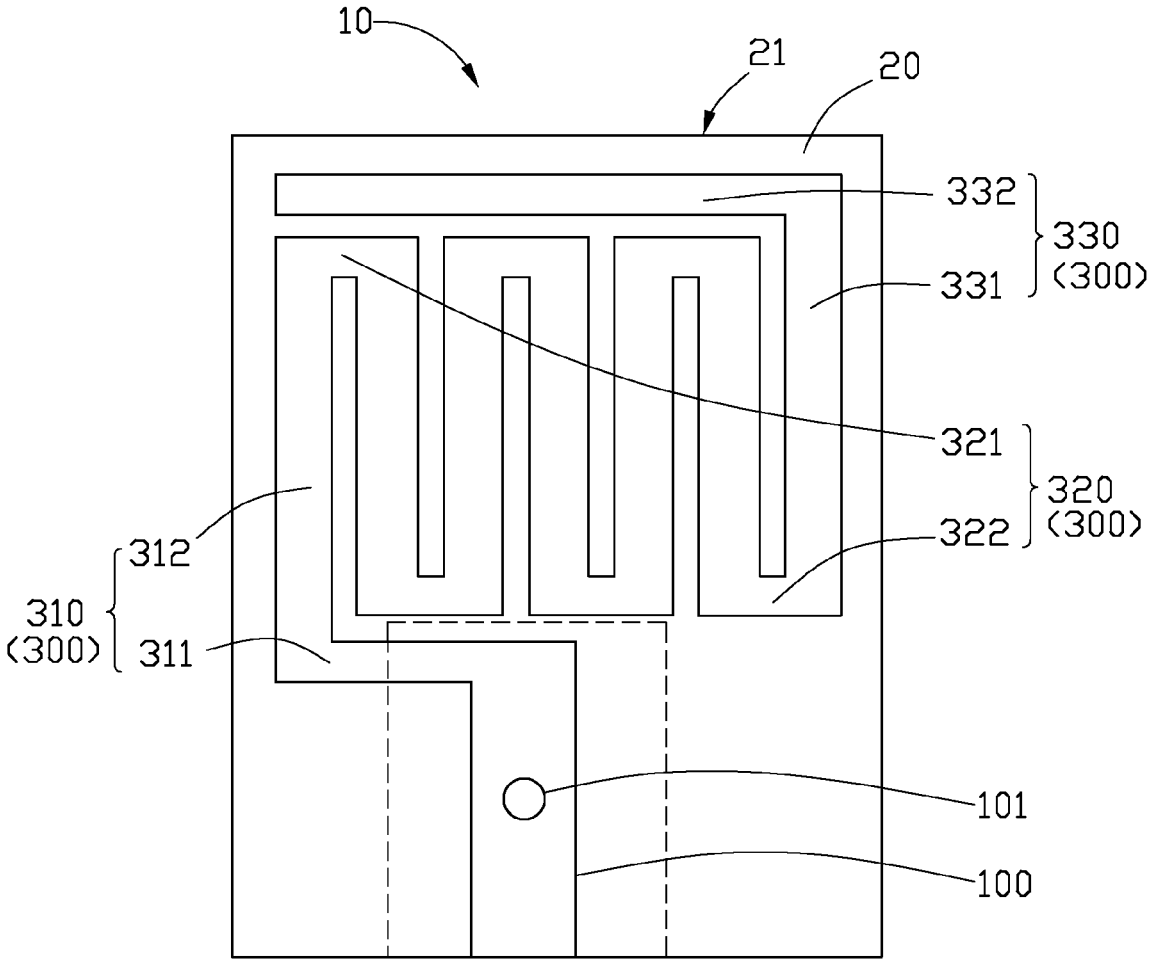
FIG. 1 is a plan view of a microstrip antenna in accordance with one embodiment of the present disclosure.
Figure 2:
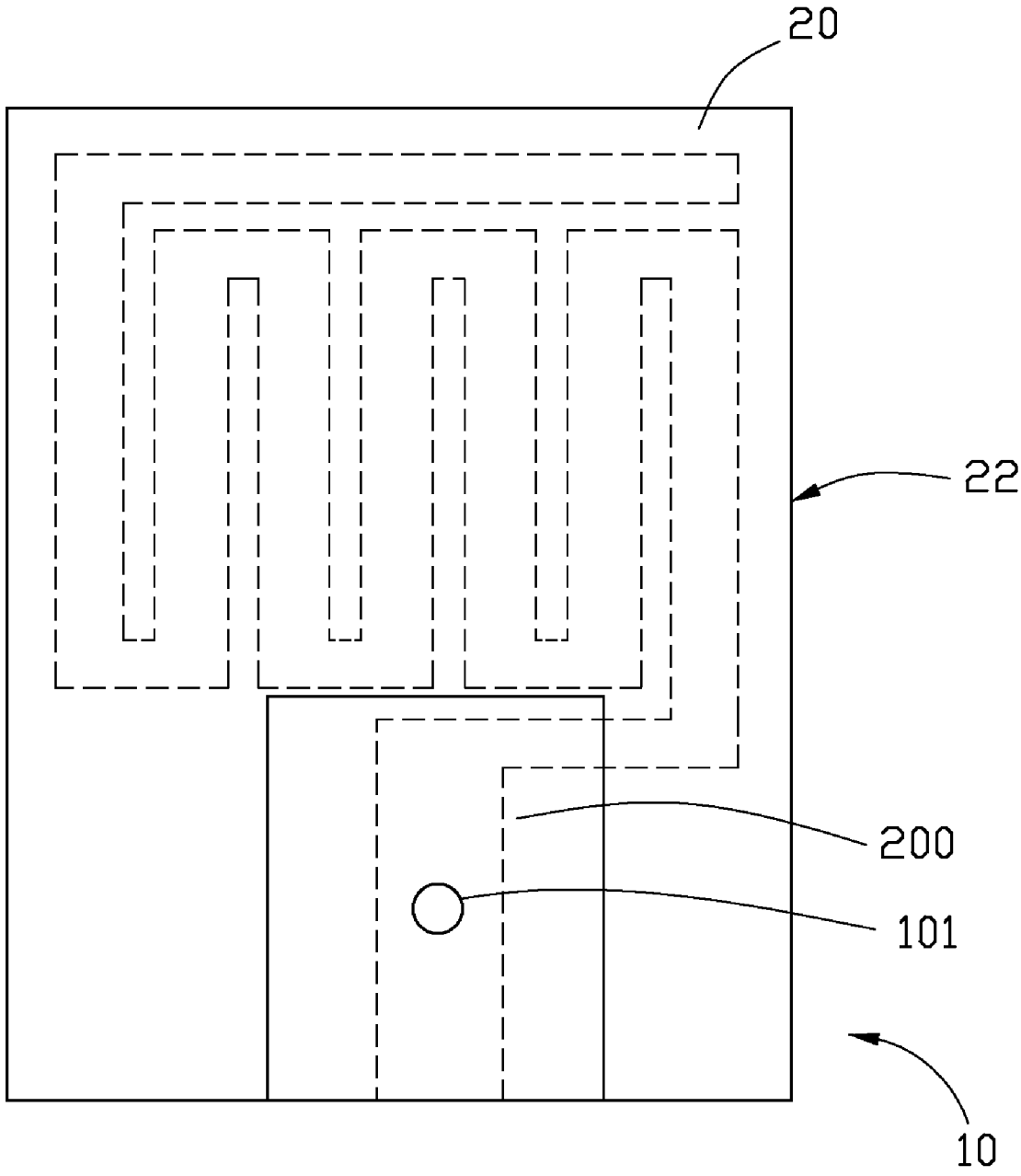
FIG. 2 is similar to FIG. 1, but viewed from another aspect.

FIG. 1 and FIG. 2 are schematic views of a microstrip antenna 10 in accordance with one embodiment of the present disclosure. The microstrip antenna 10 is positioned on a substrate 20, and includes a feeding portion 100, a grounding portion 200, and a radiating portion 300. The substrate 20 includes a first surface 21 and a second surface 22 opposite to the first surface 21.

The feeding portion 100 is positioned on the first surface 21, for feeding electromagnetic signals to the radiating portion 300. A conductive via 101 is defined in the feeding portion 100. In one embodiment, the conductive via 101 runs through the first surface 21 to the second surface 22, and electronically connects the feeding portion 100 to the grounding portion 200.

The radiating portion 300 includes a first radiator 310, a second radiator 320, and a third radiator 330. The first radiator 310 includes a first radiating section 311 and a second radiating section 312. The first radiating section 311 is electronically connected to and is substantially perpendicular to the feeding portion 100. The second radiating section 312 is electronically connects to and is substantially perpendicular to the first radiating section 311 to the second radiator 320. In one embodiment, the second radiator 320 has a zigzag shape. Depending on the embodiment, the second radiator 320 may comprise a plurality of substantially continuous W-shaped sections, S-shaped sections, or U-shaped sections. One end 321 of the second radiator 320 is perpendicular to and electronically connected to the second radiating section 312 of the first radiator 310, and the other end 322 of the second radiator 320 is perpendicular to and electronically connected to the third radiator 330. The third radiator 330 includes a third radiating section 331 and a fourth radiating section 332 perpendicular to and electronically connected to the third radiating section 331. The fourth radiating section 332 extends from the third radiating section 331 and has an end not connected to any other radiating section.

In one embodiment, a width of the second radiating section 312 of the first radiating portion 310 may be wider than a width of the first radiating section 311 as shown in FIG. 1

In one embodiment, the second radiator 320 defines a plurality of slots by its zigzag configuration to enhance coupling effects.

The third radiating section 331 of the third radiating portion 330 is wider than the fourth radiating section 332. The third radiating section 331 is perpendicular to and electronically connected to the end 322 of the second radiator 320. The fourth radiating section 322 is parallel to the first radiating section 311, and they are positioned on different sides of the second radiating portion 320. The fourth radiating section 322 forms the radiating portion 300 of the microstrip antenna 10 as shown in FIG. 1.

The grounding portion 200 is positioned on the second surface 22. In one embodiment, the grounding portion 200 is rectangular or round. The grounding portion 200 is electronically connected to the feeding portion 200 through the conductive via 101. A projection of the feeding portion 100 onto the second surface 22 is within the grounding portion 200.

Figure 3:
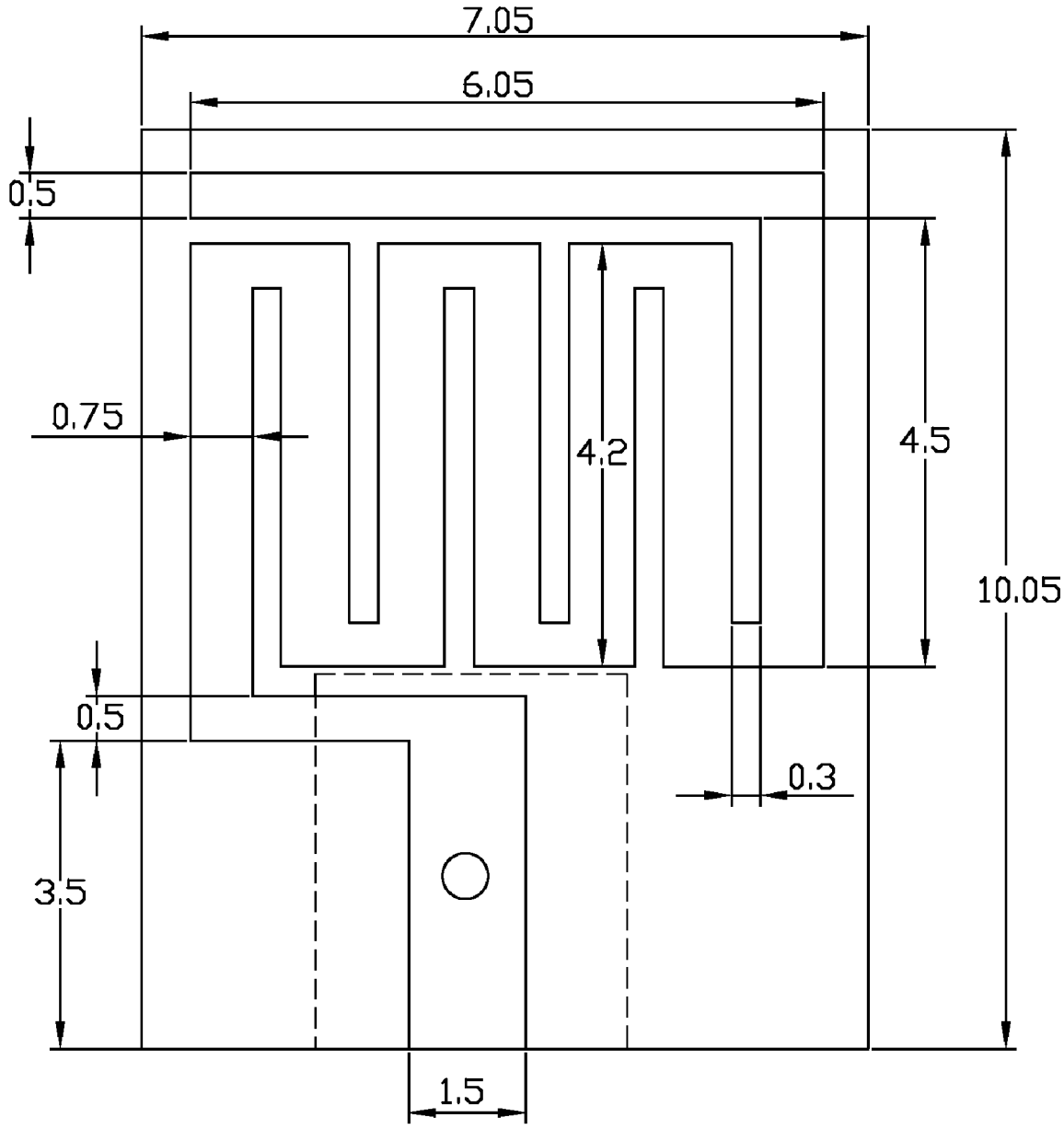
FIG. 3 illustrates one particular dimension of the microstrip antenna according to one embodiment of the present disclosure.

FIG. 3 illustrates one particular dimension of the microstrip antenna 10 according to one embodiment of the present disclosure. In the embodiment of FIG. 3, the length of the first radiating section 311 is approximately 3.5 millimetres (mm), and the width is approximately 1.5 mm. The width of the second radiating section 312 is approximately 0.5 mm, the width of the second radiator 320 is approximately 4.2 mm, the width of the bent configuration of the second radiator 320 is approximately 0.75 mm, and the width of the slot of the second radiator 320 is approximately 0.3 mm. The length of the third radiating section 331 is approximately 4.5 mm, and the width of the third radiating section 331 is approximately 0.75 mm. The length of the fourth radiating section 332 is approximately 6.05 mm, and the width the fourth radiating section 332 is approximately 0.5 mm. The length of the substrate 20 is approximately 10.05 mm, and the width of the substrate 20 is approximately 7.05 mm. It may be understood that smaller and/or larger sizes of the microstrip antenna 10 of the present disclosure may be made in substantially the same fashion and scale without departing away from the spirit of the present disclosure.

Figure 4:
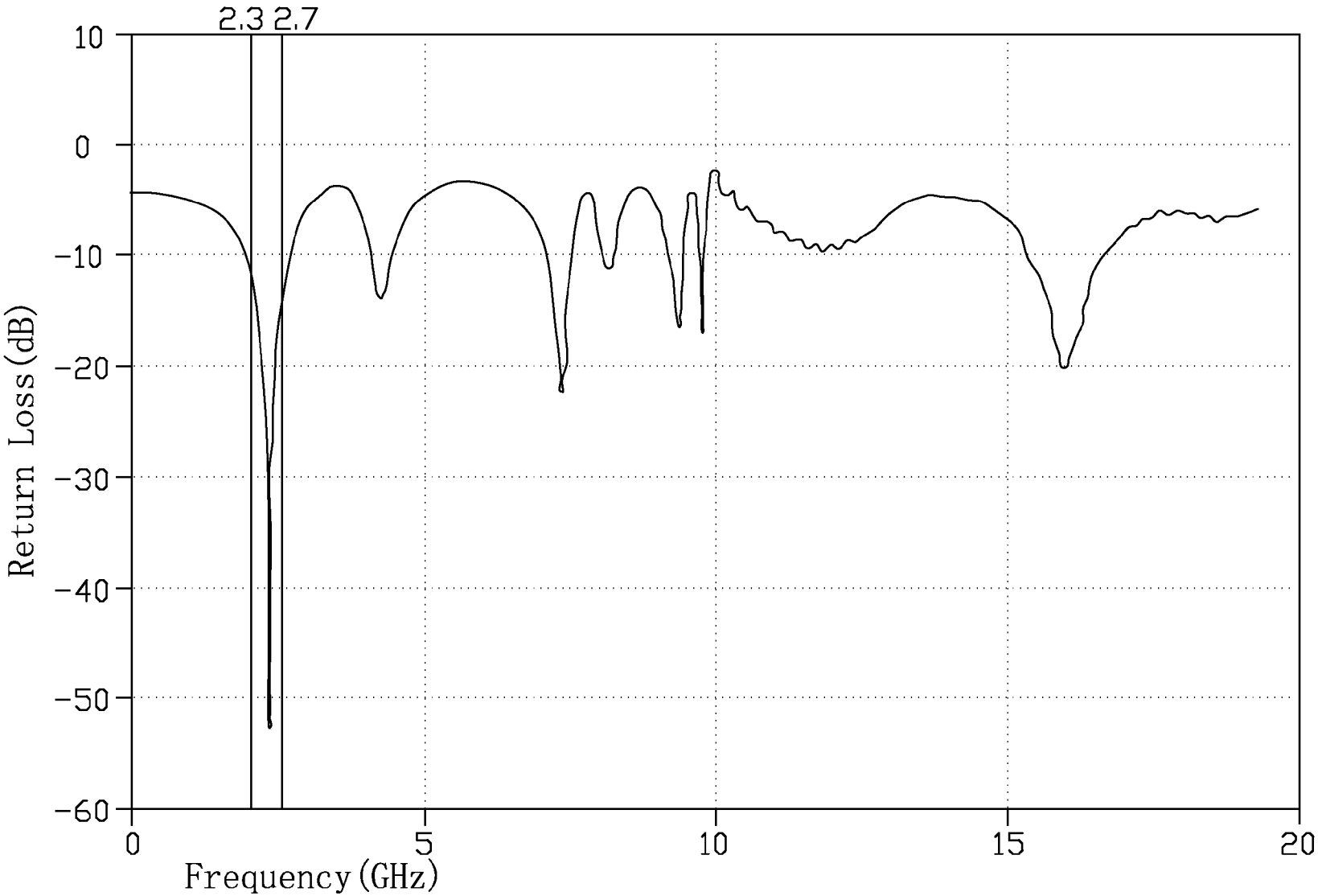
FIG. 4 is a graph showing return loss of the microstrip antenna of FIG. 1 and FIG. 2 operating at the frequency of approximately between 2.3 GHz and 2.7 GHz.

FIG. 4 is a graph showing one embodiment of a return loss of the microstrip antenna 10 of FIG. 1 and FIG. 2 operating in the frequency approximately between 2.3 GHz and 2.7 GHz. As shown, the return loss is less than −10 dB, when the microstrip antenna 10 operates in the frequency approximately between 2.3 GHz and 2.7 GHz in WiMAX standard.

The description of the present disclosure has been presented for purposes of illustration and description, and is not intended to be exhaustive or limited to the disclosure in the form disclosed. Many modifications and variations will be apparent to those of ordinary skill in the art. The embodiment was chosen and described in order to best explain the principles of the disclosure, the practical application, and to enable others of ordinary skill in the art to understand the disclosure for various embodiment with various modifications as are suited to the particular use contemplated.

What is claimed is:

1. A microstrip antenna, positioned on a substrate comprising a first surface and a second surface opposite to the first surface, the microstrip antenna comprising:

a feeding portion, positioned on the first surface, configured for feeding electromagnetic signals;

a grounding portion, positioned on the second surface and electrically connected to the feeding portion;

a radiating portion, positioned on the first surface, configured for transceiving the electromagnetic signals, the radiating portion comprising:

a first radiator, comprising a first radiating section electronically connected to the feeding portion and a second radiating section electronically connected to the first radiating section, wherein the second radiating section is substantially perpendicular to the first radiating section;

a second radiator, comprising a zigzag shape having a first end and a second end, the first end electronically connected to the second radiating section;

a third radiator, comprising a third radiating section and a fourth radiating section electronically connected to the third radiating section, wherein the third radiating section is wider than the fourth radiating section, and wherein the third radiator comprises a third end and a fourth end, wherein the third end of the third radiator is electronically connecting to the second end of the second radiator, and the fourth end of the third radiator extending from the third radiator and not connected any other radiating section, wherein the fourth radiating section is substantially perpendicular to the second radiating section of the first radiator;

wherein the first radiator and the third radiator co-define a receiving area, the second radiator positioned in the receiving area.

2. The microstrip antenna as claimed in claim 1, wherein a width of the second radiating section is wider than a width of the first radiating section.

3. The microstrip antenna as claimed in claim 1, wherein the feeding portion is electronically connected to the grounding portion through a conductive via.

4. The microstrip antenna as claimed in claim 1, wherein the second radiator comprises a plurality of substantially continuous W-shaped sections.

5. The microstrip antenna as claimed in claim 1, wherein the second radiator comprises a plurality of substantially continuous S-shaped sections.

6. The microstrip antenna as claimed in claim 1, wherein the second radiator comprises a plurality of substantially continuous U-shaped sections.

7. The microstrip antenna as claimed in claim 1, wherein one end of the second radiator is perpendicular to and electronically connected to the second radiating section.

8. The microstrip antenna as claimed in claim 7, wherein the other end of the second radiator is perpendicular to and electronically connected to the third radiating section.

9. The microstrip antenna as claimed in claim 1, wherein a projection of the feeding portion onto the second surface is within the grounding portion.

* * * * *